US007134720B2

(12) United States Patent
Viger

(10) Patent No.: US 7,134,720 B2
(45) Date of Patent: Nov. 14, 2006

(54) SUPPORT AND GLIDING MECHANISM FOR CHAIR OR SOFA

(75) Inventor: Denis Viger, Magog (CA)

(73) Assignee: Les Aciers Robond Inc., Magog (CA)

( * ) Notice: Subject to any disclaimer, the term of this patent is extended or adjusted under 35 U.S.C. 154(b) by 0 days.

(21) Appl. No.: 11/069,558

(22) Filed: Mar. 2, 2005

(65) Prior Publication Data

US 2006/0202527 A1 Sep. 14, 2006

(51) Int. Cl.
*A47C 3/03* (2006.01)

(52) U.S. Cl. ..... 297/270.1; 297/258.1; 297/261.1; 297/259.3

(58) Field of Classification Search ..... 297/270.1, 297/259.1, 261.1, 258.1, 259.3
See application file for complete search history.

(56) References Cited

U.S. PATENT DOCUMENTS 4,108,415 A * 8/1978 Hauray et al. ..... 248/370
4,544,201 A * 10/1985 Rogers, Jr. ..... 297/259.2
4,700,920 A * 10/1987 Horn ..... 248/370
5,024,483 A * 6/1991 Kamman ..... 297/273
5,344,214 A * 9/1994 Trent ..... 297/270.2
5,427,433 A 6/1995 Holobaugh, Jr.
5,857,744 A * 1/1999 LaPointe et al. ..... 297/344.22
5,931,530 A * 8/1999 Liu ..... 297/270.3
5,947,557 A 9/1999 Bellefleur
6,092,870 A 7/2000 Desnoyers et al.
6,244,658 B1 * 6/2001 Parent et al. ..... 297/270.1
6,761,405 B1 * 7/2004 Bellefleur ..... 297/270.1
2003/0015900 A1 1/2003 Lu

* cited by examiner

*Primary Examiner*—Peter M. Cuomo
*Assistant Examiner*—Erika Garrett
(74) *Attorney, Agent, or Firm*—George A. Seaby

(57) ABSTRACT

A gliding mechanism for a chair or sofa includes a bottom frame having a pair of parallel sides, a pair of swing arms pivotally connected to the interior of the sides near each end thereof defines a parallelogram linkage. A tube connected to and extending beyond the bottom ends of one pair of swing arms pivotally supports a pair of bars at the bottom of a chair or sofa support frame, and a second tube rotatably connected to the other swing arms supports a linkage which also defines part of the chair support frame, whereby the swing arms and support frame glide in unison.

7 Claims, 5 Drawing Sheets

SUPPORT AND GLIDING MECHANISM FOR CHAIR OR SOFA

BACKGROUND OF THE INVENTION

1. Field of the Invention

The invention relates to a rocking and gliding mechanism for a chair or sofa.

2. Discussion of the Prior Art

Rocking and gliding mechanisms for chairs or sofas of the type described herein are disclosed, for example in U.S. Pat. No. 5,427,433, issued to R. E. Holobough Jr. on Jun. 27, 1995; U.S. Pat. No. 5,947,557, issued to P. Bellefleur on Sep. 7, 1999 and U.S. Pat. No. 6,092,870, issued to C. Desnoyers et al on Jul. 25, 2000, and U.S. Patent Application No. 2003/0015900, published on Jan. 23, 2003.

More often than not, currently existing gliding and rocking mechanisms are structurally complicated and/or present stability problems; i.e. the chair or sofas mounted on the mechanisms tend to move laterally as well as forward and backwards during gliding or rocking. Thus, the chairs or sofas do not have a smooth gliding action. Mechanisms including a plurality of linkages in the form of pivotally interconnected bars, strips or sheets of metal are often bulky and expensive to produce.

GENERAL DESCRIPTION OF THE INVENTION

The object of the present invention is to provide a relatively simple rocking and gliding mechanism for a chair or sofa which is easily mass produced and which possesses lateral stability, resulting in a smooth gliding or rocking action.

Accordingly, the invention relates to a gliding mechanism for a chair or sofa comprising a base for supporting the mechanism on a flat surface;

a bottom frame on said base including a crossbar having a pair of free ends extending laterally from said base, parallel sides connected to the free ends of the crossbar, said sides having first and second ends, a first pair of swing arms having top and bottom ends, said top ends being pivotally connected to the interior of said first ends of said sides, and a second pair of swing arms having top and bottom ends, said top ends being pivotally connected to the interior of the second ends of said sides; and a chair support frame mounted on said bottom frame including a first tube extending between and fixedly connected to the bottom ends of said first swing arms, said first tube having free ends extending outwardly beyond said bottom frame slides, a second tube extending between and rotatably connected to the bottom ends of said second swing arms, said second tube having free ends between said bottom frame sides; first and second chair support bars pivotally connected to said free ends of said first tube and extending upwardly therefrom; a top crossbar on said first chair support bars, and a third chair support bar extending upwardly from said second tube to the center of said top crossbar, whereby when a gliding force is applied to the top crossbar and chair support bars, said first and second swing arms swing in unison, and said top frame glides as a unit on said bottom frame.

BRIEF DESCRIPTION OF THE DRAWINGS

The invention is described in greater detail below with reference to the accompanying drawings, wherein.

In the following detailed description of the preferred embodiment of the invention, wherever possible the same reference numerals have been used to identify the same or similar elements.

DESCRIPTION OF THE PREFERRED EMBODIMENT

Figure 1:
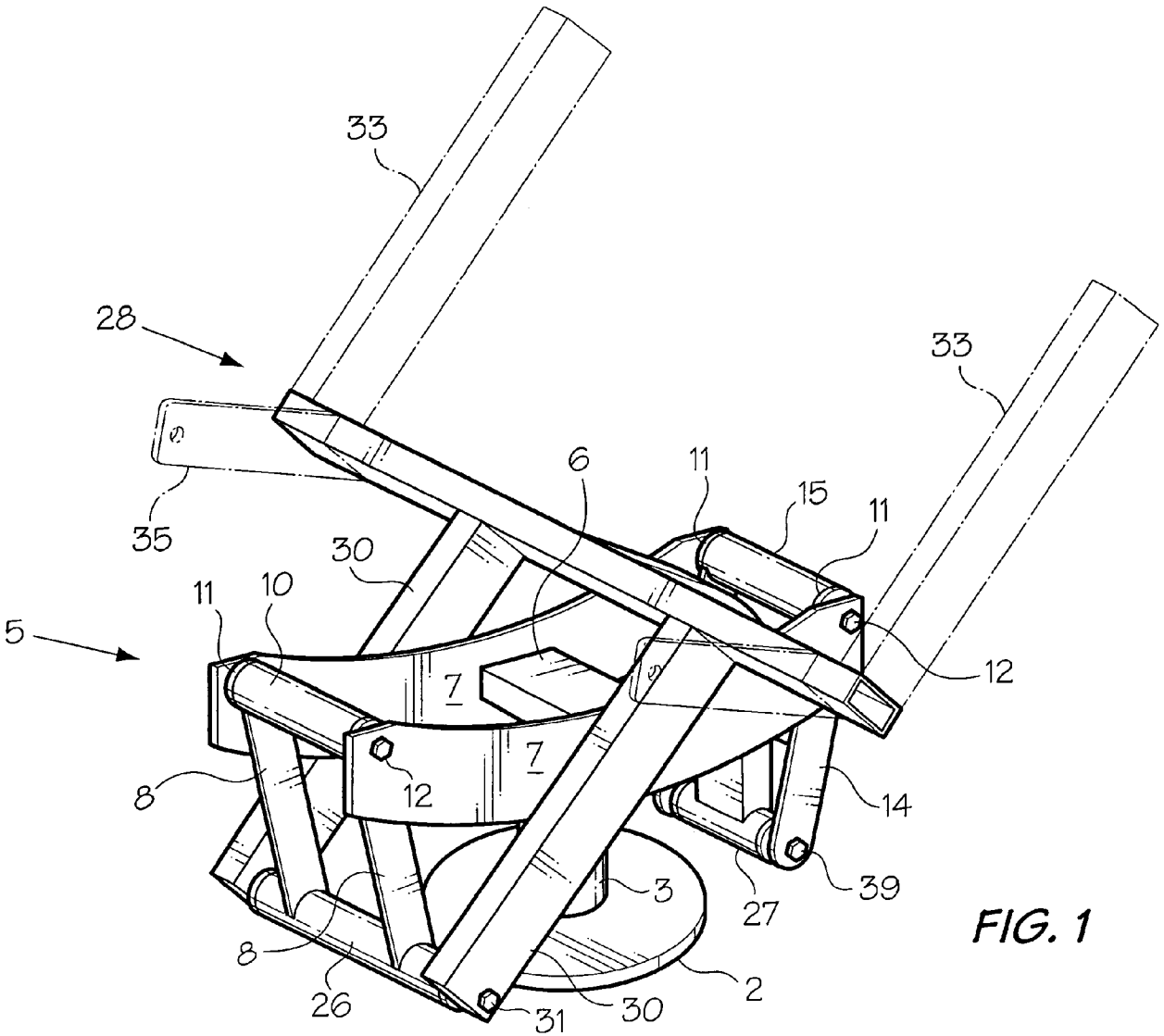
FIG. 1 is an isometric view of a gliding mechanism for a gliding or rocking chair as seen from the front and one side.
Figure 2:
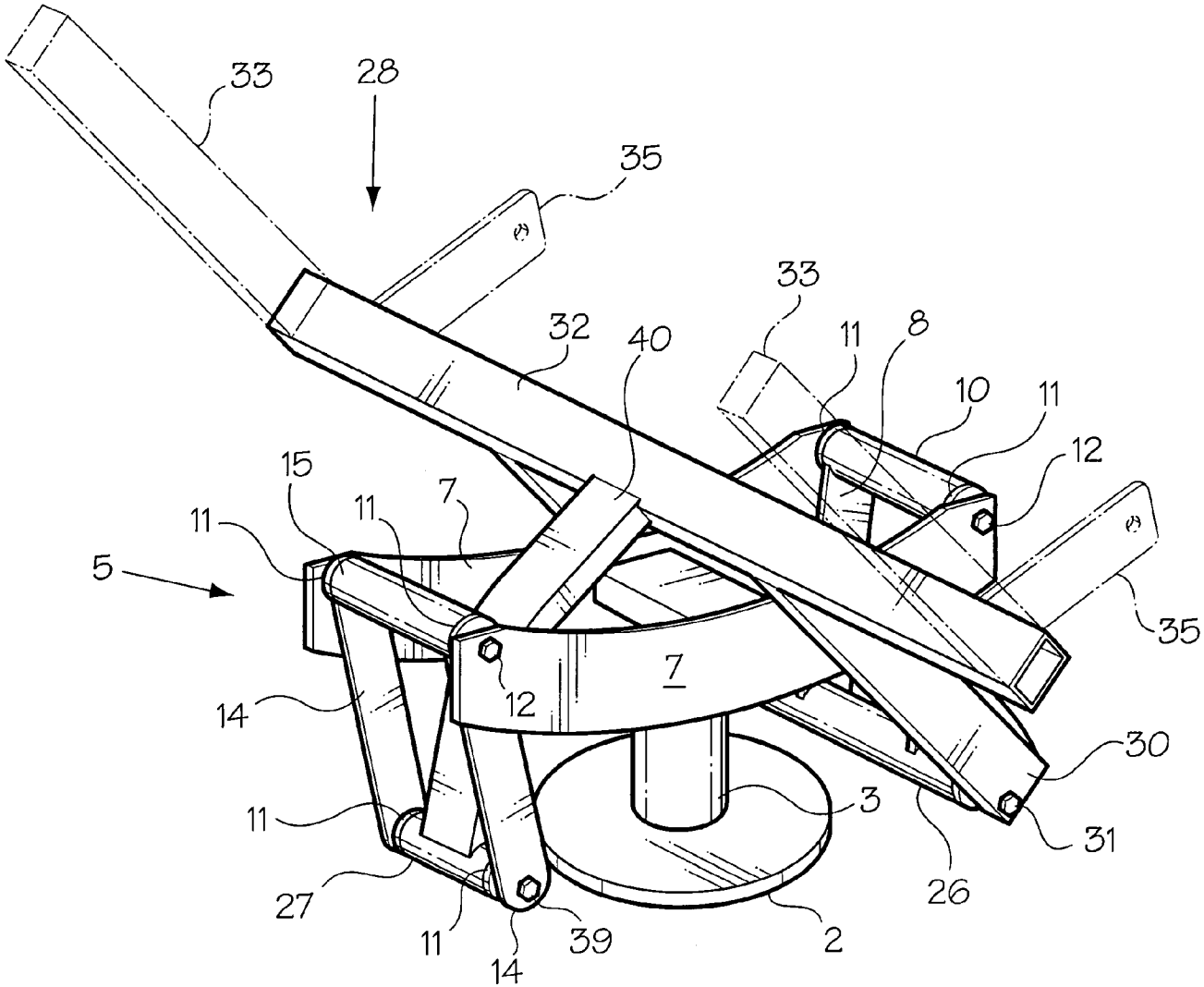
FIG. 2 is an isometric view of the mechanism of FIG. 1 as seen from the rear and the other side thereof.
Figure 3:
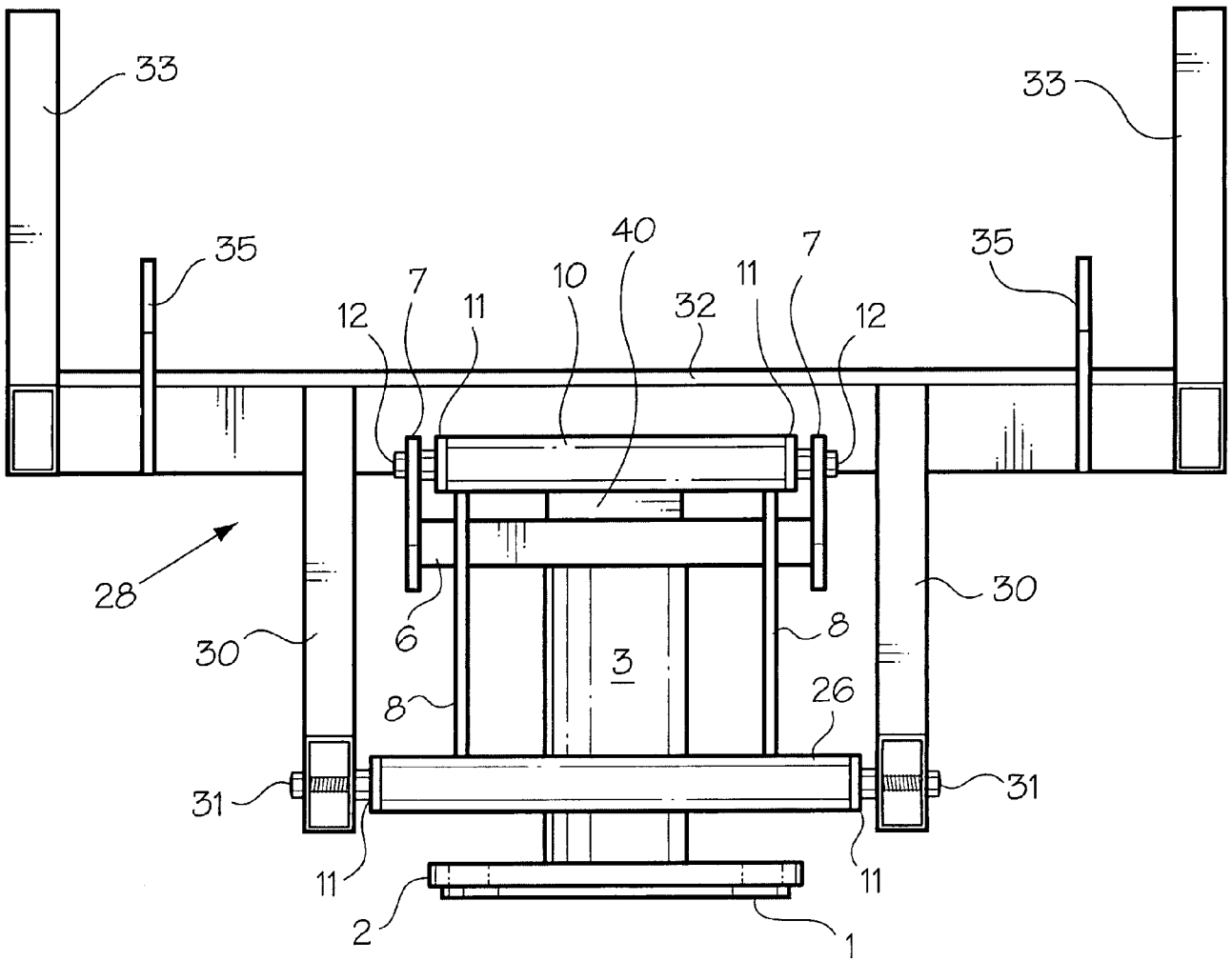
FIG. 3 is a front view of the gliding mechanism of FIGS. 1 and 2.

Referring to FIGS. 1 to 3, the gliding mechanism of this invention is mounted on a base defined by a circular baseplate 1, a turntable 2 (FIG. 3) rotatable on the baseplate, and a post 3 extending upwardly from the turntable 2. The baseplate 1 and the post 3 can be solid, one-piece elements as is conventional in existing gliders or rocking chairs of the type disclosed herein. Moreover, the post 3 can be vertically adjustable as is usually the case with office or computer chairs.

A bottom frame indicated generally at 5 is mounted on the top end of the post 3. The frame 5 includes a crossbar 6 mounted on and extending laterally outwardly from the base and arcuate side plates 7 connected to each free end of the crossbar 6 at a location spaced apart from the base post 3. First swing arms 8 are mounted on a tube 10 near the ends thereof, and the tube is pivotally connected to the inside of the top front corners of the side plates 7 by bearings 11 and bolts 12. Second swing arms 14 are mounted on a tube 15, and the tube is pivotally connected to the top rear corners of the side plates 7 by bearings 10 and bolts 12.

Figure 4:
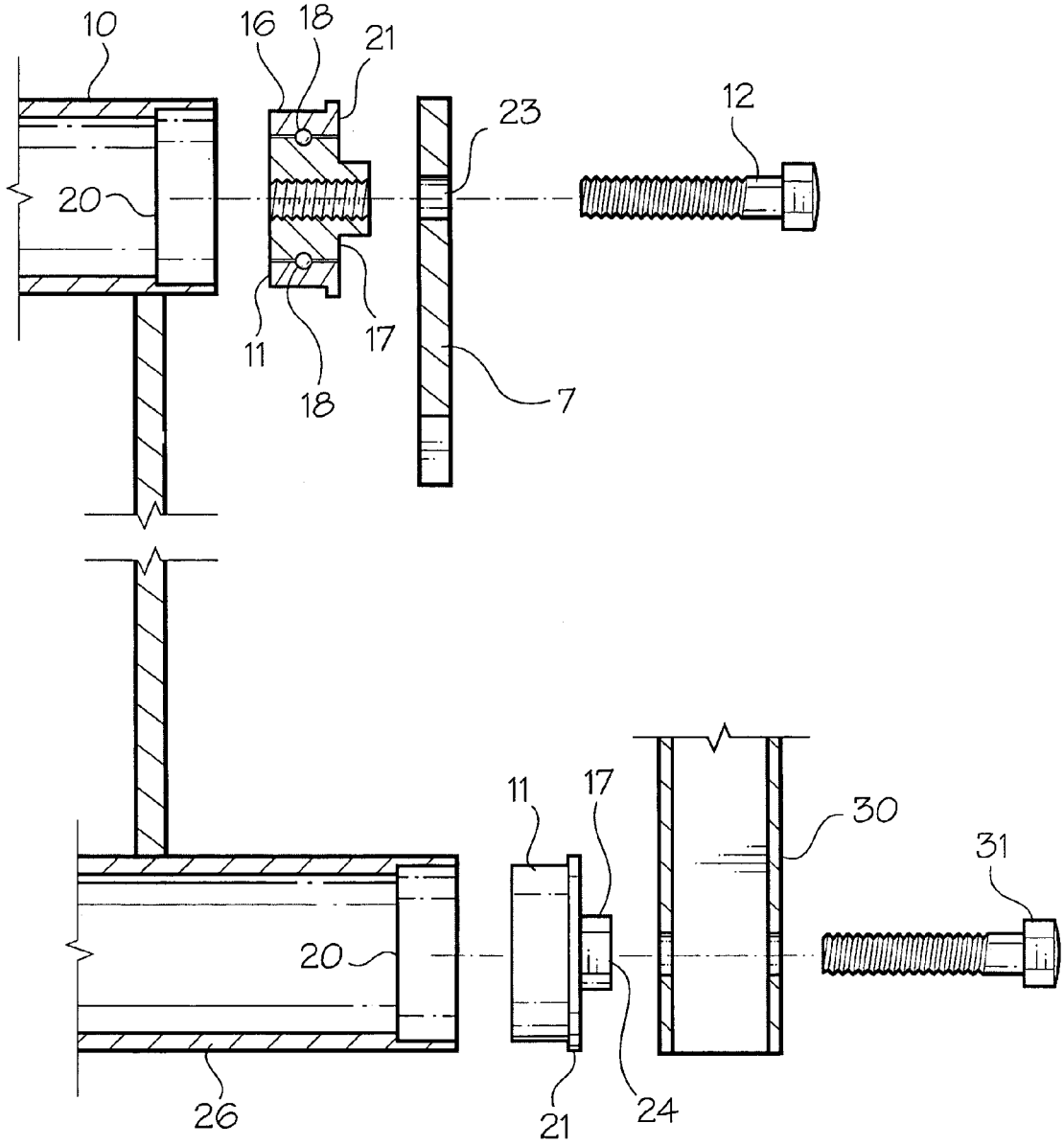
FIG. 4 is a sectioned, exploded view of one front corner of the gliding mechanisms of FIGS. 1 and 3.

Because the connections between the tubes 10 and 15 carrying the front and rear swing arms 8 and 14, respectively and the side plates 7 are the same, only the assembly on one side of the front end of the frame 5 is shown in detail in FIG. 4. In each case, the bearings 11 are mounted in the ends of the tubes 10 and 15. Each bearing 11 includes a sleeve or bearing race 16, an internally threaded hub 17 extending out of the sleeve 16 and balls 18, so that the sleeve is rotatable relative to the hub 17. Internal shoulders 20 in the ends of the tubes 10 and 15 and flanges 21 on the bearings 11 limit movement of the bearings into the tubes.

During assembly of the mechanism, the bearing sleeves 16 are inserted into the outer ends of the tubes 10 and 15, the tube 10 and 15 are inserted between the sides 7 of the bottom frame 5 and the bolts 11 are inserted through holes 23 in the top corners of the side plates 7 and threaded into the bearing hubs 17. Because the hub 17 is rotatable in the sleeve 16, flat areas 24 (one shown—FIG. 3) are provided on opposite sides of the outer end of each hub so that the hub 17 can be held stationary while the bolt 12 is rotated.

Tubular members 26 and 27 are connected to bottom ends of the swing arms 8 and 14. The members 26 and 27 carry of a chair support frame indicated generally at 28. The members 26 at the front end of the base frame 5 is fixed to the swing arms 8 and extends outwardly beyond the side plates 7. The bottom ends of tubular bars 30 are pivotally connected to the ends of the members 26 by bearings 11 and bolts 31. The bars 30 extend upwardly and rearwardly from the ends of the member 26. An elongated crossbar 32 is connected to the top ends of the bars 30. Chair support arms 33 extend upwardly and rearwardly from the ends of the top crossbar 32, and ears or lugs 35 extend upwardly and forwardly from the crossbar.

Figure 7:
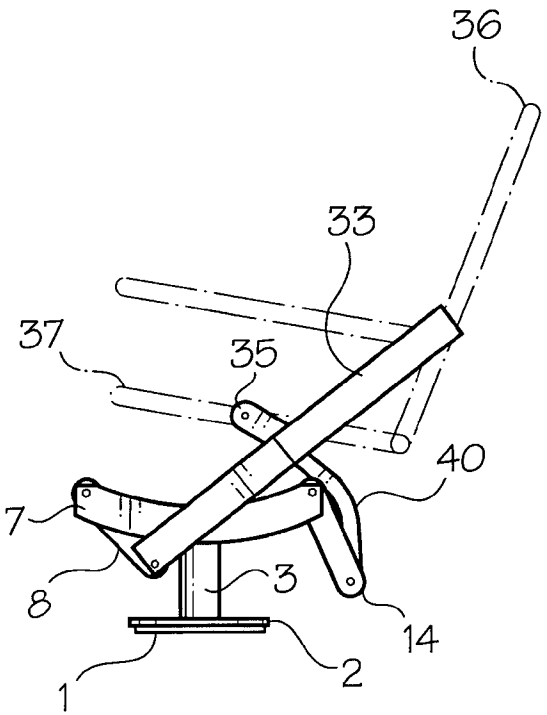
FIGS. 5 to 7 are schematic side views of the mechanism of FIGS. 1 to 3 illustrating the operation thereof.
Figure 6:
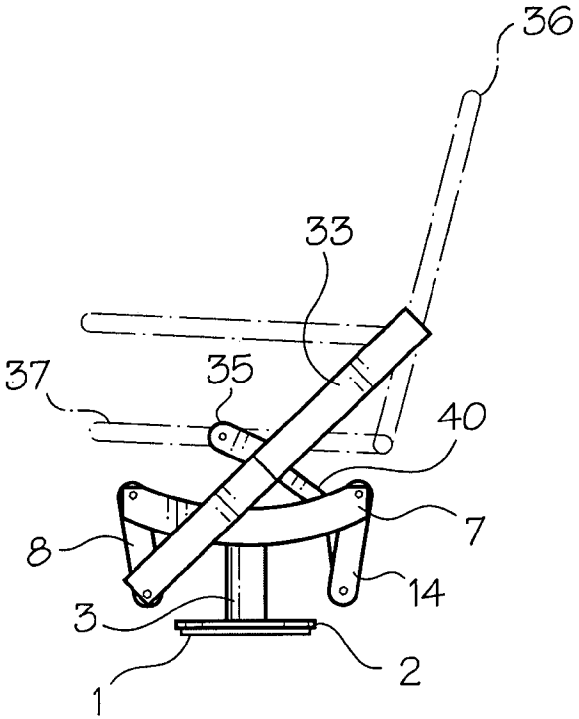
Figure 5:
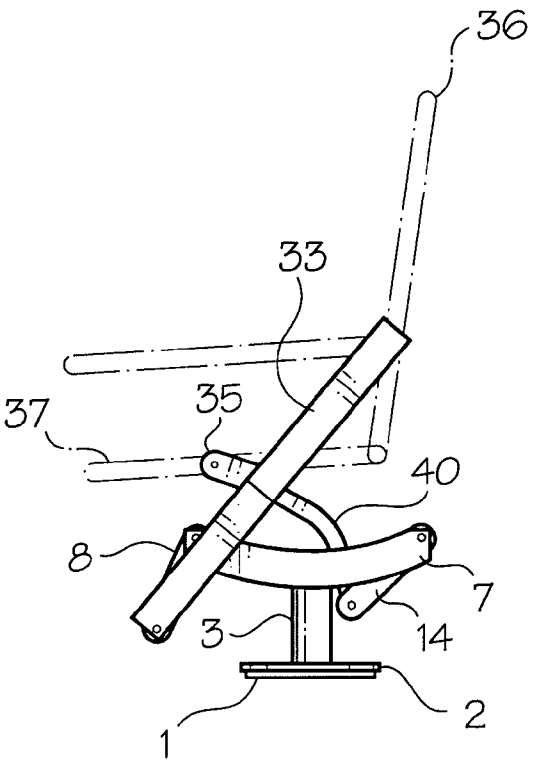

With reference to FIGS. 5 to 7, the top ends of the arms 33 are pivotally connected to a chair back 36, and the ears 35 are pivotally connected to the chair seat 37. Thus, as the chair support frame 28 moves longitudinally of the bottom frame 5, a gliding action is imparted to the chair.

The tubular member 27 at the rear of the mechanism is pivotally connected to the bottom ends of the swing arms 14 by bearings 11 and bolts 39. A generally inverted V-shaped bar 40 extends upwardly and forwardly from the center of the member 27 to the center of the top crossbar 32. Thus, the chair support frame 28 glides as a single unit on the bottom frame 5, the swing arms 8 and 14 defining a parallelogram linkage between the bottom frame and the chair supporting frame.

It will be appreciated that the mechanism can be reversed, i.e. the front end can be the rear end and vice versa in which case it would be necessary to change the top end of the chair support frame. However, the parallelogram linkage between the bottom frame and the swing arms would remain the same as would the bottom portion of the chair support frame, i.e. the bars 30 and 40.

The invention claimed is:

1. A gliding mechanism for a chair or sofa comprising a base for supporting the mechanism on a flat surface;

a bottom frame on said base including a crossbar extending laterally outwardly from said base, said crossbar having free ends spaced apart from said base; parallel sides connected to the free ends of the crossbar, said sides having first and second ends, a first pair of swing arms having top and bottom ends, said top ends being pivotally connected to the interior of the first ends of said sides, and a second pair of swing arms having top and bottom ends, said top ends being pivotally connected to the interior of the second ends of said sides; and a chair support frame mounted on said bottom frame including a first member extending between and fixedly connected to the bottom ends of said first swing arms, said first member having free ends extending outwardly beyond said bottom frame slides, a second member extending between and rotatably connected to the bottom ends of said second swing arms, said second member having free ends between said bottom frame sides; first and second chair support bars pivotally connected to said free ends of said first member and extending upwardly therefrom; a top crossbar on said first chair support bars, and a third chair support bar extending upwardly from said second member to the center of said top crossbar, whereby when a gliding force is applied to the top crossbar and chair support bars, said first and second swing arms swing in unison, and said top frame glides as a unit on said bottom frame.

2. The gliding mechanism of claim 1, including a third member extending between and fixedly connected to top ends of said first swing arms; first bearings rotatably connecting the ends of said third member to said bottom frame sides; a fourth member extending between and fixedly connected to top ends of said second swing arms; and second bearings rotatably connecting the ends of said fourth member to said bottom frame sides.

3. The gliding mechanism of claim 2, wherein said first ends of said bottom frame sides are at a front end of the mechanism, and said second ends of said bottom frame sides are at a rear end of the mechanism.

4. The gliding mechanism of claim 1, wherein said first and second members are tubular.

5. The gliding mechanism of claim 2, wherein said first, second, third and fourth members are tubular.

6. The gliding mechanism of claim 1, wherein said sides have concave upper ends for providing clearance between said sides and said top crossbar during gliding of said top frame on said bottom frame.

7. The gliding mechanism of claim 6, wherein said first and second chair support bars are straight, and said third chair support bar has an inverted V-shape for providing clearance between said third chair support bar and said top crossbar during gliding of said top frame on said bottom frame.

* * * * *